US006581263B1

(12) United States Patent
Bonny et al.

(10) Patent No.: US 6,581,263 B1
(45) Date of Patent: Jun. 24, 2003

(54) PROCESS AND APPARATUS FOR PRODUCING AN ASSEMBLY LINKAGE ON A HOLLOW PROFILE

(75) Inventors: Pierre Bonny, Hamburg (DE); Thomas Huelsberg, Rosengarten (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 09/127,915

(22) Filed: Aug. 3, 1998

(30) Foreign Application Priority Data

Aug. 2, 1997 (DE) ..... 197 33 476

(51) Int. Cl.[7] ..... B23P 17/00
(52) U.S. Cl. ..... 29/421.1; 72/57
(58) Field of Search ..... 29/421.1, 523, 29/507, 890.148; 72/57, 61, 60, 357, 358, 56

(56) References Cited

U.S. PATENT DOCUMENTS

| | | | | |
|---|---|---|---|---|
| 3,820,369 A | * | 6/1974 | Tominaga et al. | |
| 3,921,280 A | * | 11/1975 | King, Jr. | 29/253 X |
| 4,453,304 A | * | 6/1984 | Astill et al. | 29/421.1 |
| 4,689,979 A | * | 9/1987 | Otsuka et al. | 72/57 |
| 5,022,135 A | * | 6/1991 | Miller et al. | |
| 5,275,325 A | * | 1/1994 | Stracquadaini | 72/60 X |
| 5,435,163 A | * | 7/1995 | Schafer | 29/421.1 |
| 5,735,156 A | * | 4/1998 | Yoshitomi et al. | 29/421.1 |
| 5,799,524 A | * | 9/1998 | Schafer et al. | 25/421.1 X |
| 5,890,387 A | * | 4/1999 | Roper et al. | 25/421.1 X |
| 5,940,951 A | * | 8/1999 | Schulz et al. | 25/421.1 O |
| 5,979,201 A | * | 11/1999 | Horton et al. | |

FOREIGN PATENT DOCUMENTS

| | | | | |
|---|---|---|---|---|
| DE | 41 03 083 C1 | | 5/1992 | |
| DE | 195 08 632 | | 9/1996 | |
| DE | 195 18 252 A1 | | 11/1996 | |
| EP | 0 824 047 A1 | | 2/1998 | |
| JP | 53-152080 | * | 12/1980 | |
| JP | 57165134 | * | 3/1981 | |
| JP | 08090097 A | * | 9/1996 | |
| SU | 837441 | * | 6/1981 | 72/61 |
| WO | WO 95/31635 | | 11/1995 | |

* cited by examiner

*Primary Examiner*—Dang Ton
*Assistant Examiner*—Steve Blount
(74) *Attorney, Agent, or Firm*—Crowell & Moring LLP

(57) ABSTRACT

A process and a device produces an assembly linkage on a hollow profile which is shaped for the installation of the assembly part by internal high-pressure remodeling. In order to achieve the shaping of an assembly linkage in a component space-saving, for a subsequent assembly correctly positioned, and with regard to its contour exactly fitted to the assembly part, in simple manner and even with high degrees of remodeling in a secure process, the hollow profile, under internal pressure, which is smaller than the remodeling pressure, is indented at the place of the to-be-produced assembly linkage by a die and by forming a rough contour. Afterward, while the die remains in this indenting position, a fluid high pressure is created in the hollow profile. Thereby, the hollow profile sides surrounding the die are molded to the external contour of the die, and that after releasing the fluid high pressure and the subsequent removal of the die, the finished trough-shaped assembly linkage is released.

4 Claims, 3 Drawing Sheets

PROCESS AND APPARATUS FOR PRODUCING AN ASSEMBLY LINKAGE ON A HOLLOW PROFILE

BACKGROUND OF THE INVENTION

This application claims the priority of German application 197 33 476.8, filed Aug. 2, 1997, the disclosure of which is expressly incorporated by reference herein.

The present invention concerns a process for producing an assembly linkage or connection on a hollow profile which is shaped for attachment of an assembly part by internal high-pressure processes, and an apparatus for carrying out the process.

DE 41 03 083 C1 describes a metal pipe junction which is produced by internal high-pressure forming or remodeling. Partly circular cylindrical protrusions with plane assembly surfaces are shaped simultaneously for each air/fuel ratio detector. Such protruding assembly surfaces, as a consequence of internal high-pressure remodeling, are shaped exactly in the correct position for the respective purpose; however, they require additional space for components which is undesirable in tight assembly spaces. In addition, while precisely calibrated assembly surfaces can be produced on the assembly part, the specifically shaped remodeling or forming tool for this process is very costly in its production and because of its configuration limited to a very specific kind of assembly surface. Thus, such tool is essentially completely useless for producing differently shaped assembly surfaces. Moreover, the production of assembly surfaces, which require high degrees of remodeling of hollow profile, is not possible in a safe manner, as the pure widening soon surpasses the expandability of the hollow profile, whereupon the hollow profile then bursts.

An object of the present invention is to further improve a process and also an apparatus so that, for shaping of a component part, space-saving, for the subsequent assembly correctly placed, and, also with regard to the contour of the assembly part, an exactly fitted assembly connection is achieved simply and safely, even with the requirement of high degrees of forming or remodeling.

In accordance with the present invention, this object has been achieved by providing that the hollow profile at an internal pressure, which is lower than the remodeling pressure, is indented by a die at the point of the to-be-manufactured assembly linkage, causing the formation of a rough contour of the assembly connection or linkage, so that afterward when the die remains in the position where it has created the indent, a fluid internal high pressure is created in the hollow profile with which the hollow profile sides, surrounding the external contour of the die, are pressed into the die, and that after the relieving of the fluid pressure and subsequent removal of the die, the manufactured trough-shaped assembly linkage is released.

In addition, the process is effected by a novel apparatus in which the notch is shaped in the form of a bore into which a die is guided, which is controlled in such a manner that, with inserted hollow profile, it can be driven into the engraving for the purpose of indenting the hollow profile at pressure conditions below the remodeling pressure and prior to the internal high-pressure remodeling pressure, and afterwards retracted from the engraving, and during the remodeling process of the hollow profile, against the remodeling pressure, it remains backstopped in its indenting position.

The present invention advantageously provides a linkage or connection for the assembly set into the hollow profile, thereby eliminating the requirements for additional space for components for fitting into one another the hollow profiles and an assembly part. Thus, the assembly can be completed in an extremely component part, space-saving manner. Because of the internal high-pressure remodeling or forming process, the linkage or connecting point on the hollow profile is formed without tolerances with regard to its relative position, and in the contour fitted in an advantageous manner through a corresponding shaping of the die in joint application with internal high pressure, as it were, in an inverted shape to the connecting point of the assembly part. Thereby, a secure, durable fitting connection is achieved between the hollow profile and the assembly part, in which an optimal form fit is attained and with it an exact fitting into one another of the two assembly pieces, the hollow profile and the assembly part.

By using a die for the shaping of the connecting or linkage point, the apparatus becomes significantly more flexible, because, through the simple substitution of the die manifold, connection points can be shaped without necessitating an entirely new tool. Also the simple substitution of the worn-out die through a new one is significantly more cost-effective than the refinishing of an entire tool, or even the replacement of a worn out tool by a new one. As a result of the present invention, linkage or connection points on the hollow profile with high degrees of forming or remodeling can be produced because, through the indenting step, a useful pre-shaping of the hollow profile is attained with which areas, which were originally further away from the connecting or linkage point before the indenting operation, are drawn in to this point so that there is enough material left over for the final shaping by internal high pressure.

Moreover, the thus-obtained additional material has been pushed in the direction of the center of the hollow profile even before the internal high-pressure impingement. Thereby, the die, by indenting of the hollow profile side alone, is fully surrounded by a rough shape which approaches the final shape of the assembly linkage. The internal high pressure then is only responsible for establishing the final contact of the hollow profile material with the die that remains in this indenting position. For this, however, only small remodeling or forming degrees are required, whereby a complete failure of the hollow profile in the form of bursting is avoided. Thus, the present invention results in a process through which the production of such an assembly linkage sunk into the hollow profile can take place safely and simply.

BRIEF DESCRIPTION OF THE DRAWINGS

Other objects, advantages and novel features of the present invention will become apparent from the following detailed description of the invention when considered in conjunction with the accompanying drawings wherein.

DETAILED DESCRIPTION OF THE DRAWINGS

Figure 1:
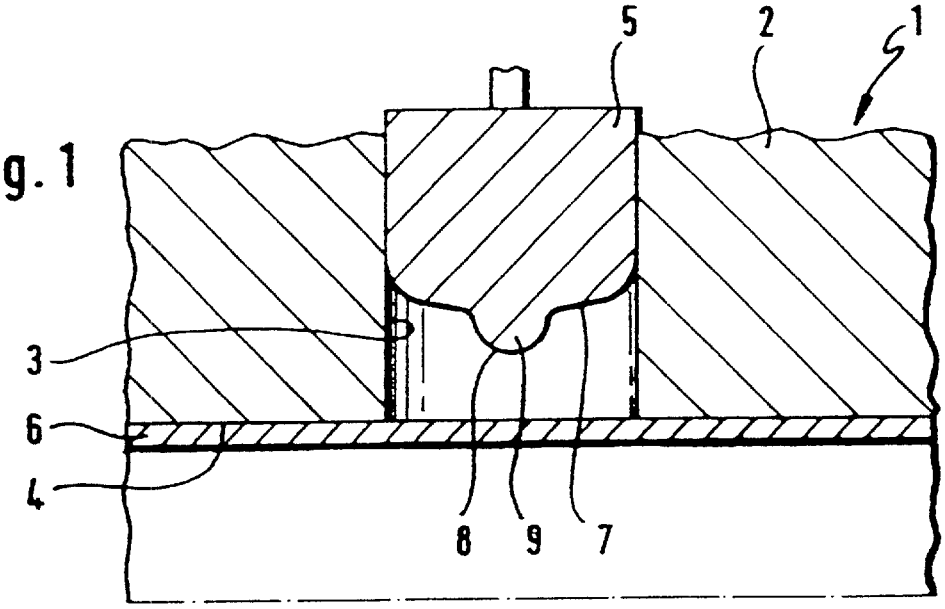
FIG. 1 is a cross-sectional elevational view, in accordance with the overall definition of the present invention, wherein the apparatus with the die, which possesses a stamping contour in its drawn back position in the bore, with regard to the engraving or forming of the internal high-pressure remodeling tool being in a pressure-neutral condition.

FIG. 1. shows an internal high-pressure forming or remodeling tool 1 of the present invention which is divided into an upper die 2 and a similar lower die which need not be shown for clarity of description. The upper die 2 has a bore 3 which leads into the engraving face or portion 4 of the tool 1. The bore 3 can have any desired geometric cross-section; however, in the illustrated embodiment it is a circular cylindrical guide bore 3.

A die is adjustably guided in the bore 3 and is back-stopped preferably by a conventional hydraulic motor. The die 5 has a stamping contour 8 in its face 7 turned toward a hollow profile 6 inserted into the engraving of die face 4. The face 7 is well-rounded and possesses at its center facing the hollow profile 6 a nap-like elevation 9. The curve of the stamping contour 8 can take any number of shapes whereby well-rounded contours are advantageous, because no possibly tear-created sharp edges appear. The stamping contour 8 has a shape which is inverted to the desired contour of the to-be-created assembly linkage, except when the die 5, in an intermediate step in the process after the indenting, is to be exchanged against another die which possesses the required contour for shaping the desired assembly linkage 10 and takes up the indenting position of the die 5.

In the foregoing manner, the hollow profile can be carefully dented with a well-rounded die, whereby the final shaping of the assembly linkage 10 through the creation of an internal high pressure can shape with a sharp edge the place taken up by the face of the die 5. However, this intermediate step requires time and additional expenditure in terms of costs and tools.

In FIG. 1, the position of the die 5 is such that the face of the die 5 is still in the bore 3, while no pressure has been created as of yet in the hollow profile 6 which has been placed into the tool 1. The pressure within the hollow profile 6, which has been filled with pressure fluid, can be atmospheric pressure or at a level below the forming or remodeling pressure. Also, the hollow profile can be empty at this time. A pressurization, nevertheless, can be advantageous, on one hand, because an unexpectedly occurring tear in the hollow profile 6 during the indenting would be easily detected through the leakage caused by the internal high pressure. The pressurization can, on the other hand, act as an undesirable resistor for the engraving-driving die 5 which indents the hollow profile 6.

Figure 2:
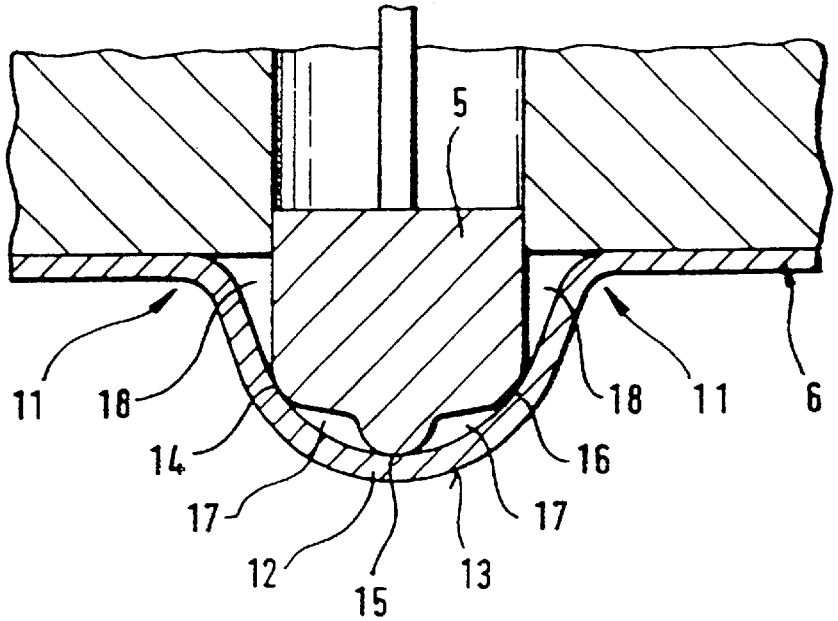
FIG. 2 is a view similar to FIG. 1 but with the die in its indenting position, with the dented hollow profile in pressure-neutral condition.

Upon closing the tool 1, in a pressure-neutral condition of the hollow profile 6, the, stamp 5 is driven out of the bore 3 onto the hollow profile 6 which is thus indented by the die 5 in accordance with FIG. 2. In the indenting step, hollow profile material is drawn upon from the adjacent areas 11 to the to-be-created linkage or connection point. On the hollow profile 6, an inward-turned dome-shape 12 is produced, while the profile side 13 only makes contact with the points 14, 15, 16, which are impinged or contacted by the die 5 during the indenting step of the hollow profile. As a result, between the hollow profile side 13 and the die 5, spaces 17, 18 are produced which are free of contact.

Figure 3:
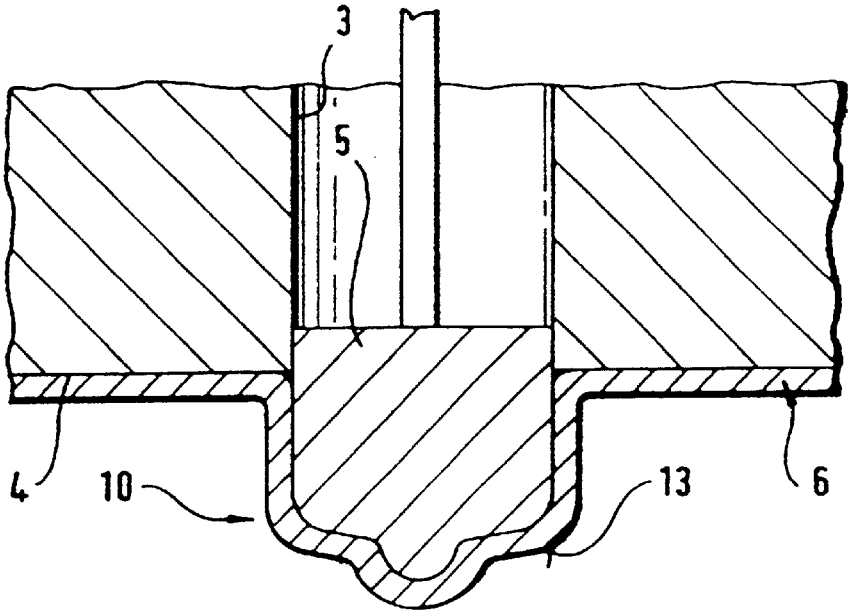
FIG. 3 is a view similar to FIG. 1 but with the die now in its indenting position and with the pre-dented hollow profile being impinged by internal high pressure.

In the subsequent step shown in FIG. 3, the pressure fluid which was filled into the hollow profile is highly pressurized while the die 5 remains in its indenting position. The die 5 is, supported by its motor during the high pressurization step. Under the pressing influence of the internal high pressure, the hollow profile side 13 is applied entirely on its face and circumference to the die 5, whereby the free spaces 17, 18 disappear. The contour of the assembly linkage 10 is thus finished, whereby in the area of the opening of the bore 3 to the engraving 4, projecting indentations of the hollow profile side 13, which resulted from the earlier indenting process, are leveled out by being pressed to the engraving 4. This guarantees a qualitatively high-grade external contour of the hollow profile 6 also in the area of the assembly linkage 10.

After the internal high-pressure forming or remodeling phase is completed, the pressure fluid is released and let out of the tool 1. Then the die 5 is retracted from the engraving portion or face 4 and with it from the trough-shaped assembly linkage 10, and returned to its original position in the bore 3. The motor for the die 5 has to be configured in such a way that in this phase it is able to easily overcome a possible jamming of the hollow profile side 13 which has been pressed through internal high pressure to the circumference of the die 5. Otherwise, the die 5 should be configured with regard to its circumference and face contour without back cutting, so that the translational retraction, from the assembly linkage 10 can be accomplished without obstruction. The retraction of the die 5 frees up the assembly linkage for the installation of an assembly part. The assembly part itself can be a component part with positioning and mounting elements for which the assembly linkage is specifically shaped, such as for example the shell structure of an automobile or an assembly part which exactly fits and is insertable into the assembly linkage 10.

Figure 4:
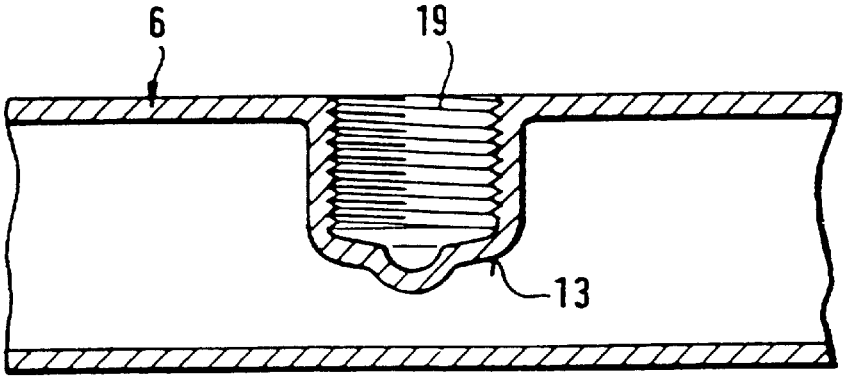
FIG. 4 is a cross-sectional view of a formed hollow profile with an internal thread for an assembly linkage produced in accordance with the overall concept of the present invention.

The die 5 can also carry on its circumference an external thread which becomes an internal thread 19 in the hollow profile side 13 by application of internal high pressure as seen in FIG. 4. After the completion of such an assembly linkage, the die 5 can be easily screwed out of the assembly linkage. The thread can be a screw thread or shaped for a bayonet fitting. In this extremely simple manner, on curved surfaces such as those on the hollow profile 6, screw connections or linkages can be shaped without intermediate parts, or without costly welding or gluing operations.

Figure 5:
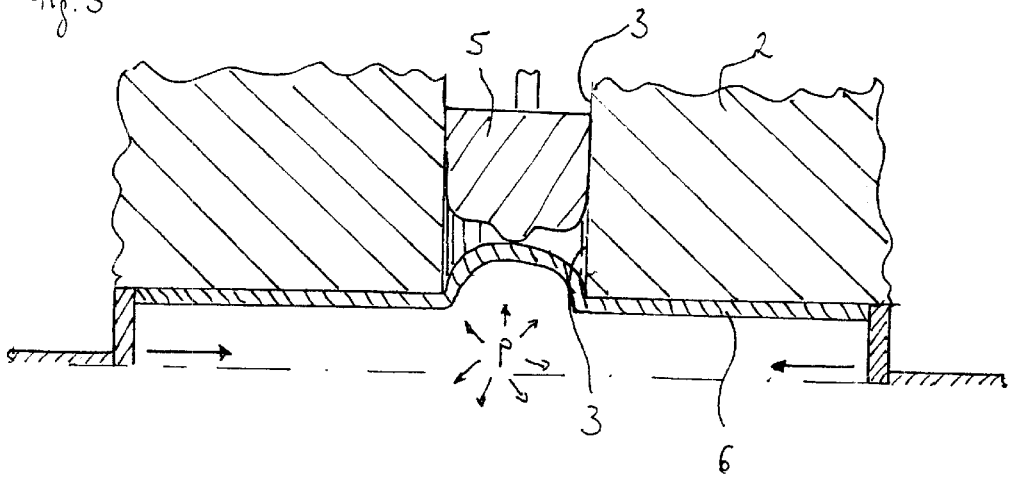
FIG. 5 is a cross-sectional view showing that the hollow profile is expanded through internal pressure into the bore of the die before the indenting process.
Figure 6:
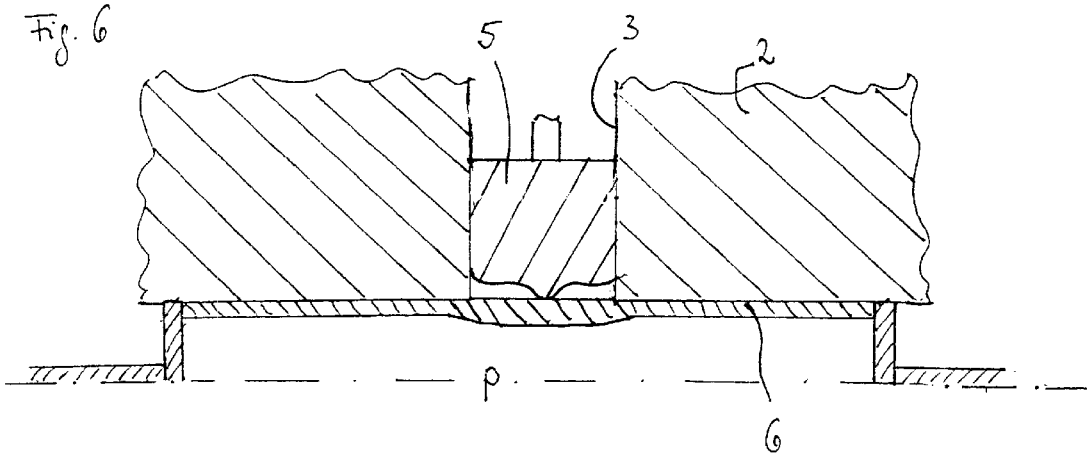
FIG. 6 is a cross-sectional view showing the production of additional profile material during the widening of the hollow profile with the axial die.

Moreover, an internal high-pressure forming or remodeling process can be conducted before the indenting with the die 5, with the objective of expanding the hollow profile 6 into the bore 3 of the die 5 as seen in FIG. 5, whereby the die 5 is retracted further and serves as the backstop for the side element. Simultaneously with the expansion, additional hollow profile material can be channeled to the area where it is required by two axial dies which impinge upon the ends of the hollow profile 6 as seen in FIG. 6, so that the expansion does not cause the material to fail by bursting of the hollow profile 6. The side element is then pressed by the die 5 into the original shape of the hollow profile 6. This operation can occur at internal high pressure, when the material of the side element is still cold-flowing and does not exhibit frozen stress conditions as the consequence of cold-hardening, or for the relieve of the to-be-produced feed power for the die 5 at a pressure which is smaller than the remodeling or forming pressure.

Through the process phase for the shaping of the side element, hollow profile material is provided for the mechanical indenting because the production of the variant element utilizes not only hollow profile side material covering the opening of the bore 3, which is pressed into the bore 3, but also areas adjacent to the side of the hollow profile, which is furthermore forced by the subsequent pushing. Therefore, there is sufficient hollow profile material to fulfill the requirement of high degrees of forming or remodeling in the indenting process which is conducted below the internal high-pressure forming pressure, and to provide safety and security in carrying out this step of the process.

Moreover, after the indenting and while fitting the hollow profile side 13 to the circumference and the face 7 of the die 5, additional hollow profile material can be provided by two adjustable axial dies which hold the hollow profile by its ends and are attached to the tool 1. Thereby, the security of the forming process further as a result of the additionally available hollow profile material is assured.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for forming an assembly linkage on a hollow profile by internal high-pressure shaping of the hollow profile, comprising the steps of:

(a) indenting the hollow profile with a die movable in a bore transverse to the hollow profile at a discrete location on the hollow profile only where the assembly linkage is to be formed without deforming a remaining portion of the hollow profile outside the discrete location and with an internal pressure in the hollow profile that is less than a shaping pressure during a subsequent internal high pressure shaping to create a coarse contour of the assembly linkage, (b) shifting additional hollow profile material to the bore by at least one axial die while producing an internal high fluid pressure in the interior of the hollow profile, with the die remaining at the indentation location, such that walls of the hollow profile surrounding the die in the discrete location are pressed as a result against the outside contour of the die to form a finished assembly linkage, (c) thereafter releasing the internal high fluid pressure, (d) removing the die, and (e) releasing the finished assembly linkage.

2. Process according to claim 1, wherein an internal thread is shaped through an internal high pressure with a corresponding invertedly shaped contour of a die in a connection trough of the hollow profile.

3. Process according to claim 1, wherein the hollow profile is expanded through internal high pressure into the bore of the die before the indenting step, and thereafter the developed side element is reshaped, with regard to an external contour thereof, to the original shape of the hollow profile by pushing the die.

4. Process according to claim 3, wherein additional hollow profile material is produced during the widening of the hollow profile by at least one axial die.

* * * * *